US005362593A

United States Patent [19]

Inoue et al.

[11] Patent Number: 5,362,593

[45] Date of Patent: Nov. 8, 1994

[54] ELECTROPHOTOGRAPHIC TONER HAVING IMPROVED LOW TEMPERATURE FIXING PROPERTIES, OFF-SET RESISTANCE AND HEAT RESISTANCE

[75] Inventors: Masahide Inoue; Koichi Tsuyama, both of Nara; Hidenori Asada, Hirakata; Takeshi Arakawa, Osaka, all of Japan

[73] Assignee: Mita Industrial Co., Ltd., Osaka, Japan

[21] Appl. No.: 890,159

[22] Filed: May 29, 1992

[30] Foreign Application Priority Data

May 31, 1991 [JP] Japan ..... 3-129290

[51] Int. Cl.[5] ..... G03G 9/087

[52] U.S. Cl. ..... 430/111

[58] Field of Search ..... 430/106, 109, 110, 111

[56] References Cited

U.S. PATENT DOCUMENTS 4,806,635 2/1989 Chupka ..... 430/109
5,082,883 1/1992 Alexandrovich et al. ..... 524/109
5,156,937 10/1992 Alexandrovich et al. ..... 430/110

FOREIGN PATENT DOCUMENTS 89-210291 6/1989 Japan .
90-025891 7/1989 Japan .
474(P-1117) 10/1990 Japan .

*Primary Examiner*—John Goodrow
*Attorney, Agent, or Firm*—Beveridge, DeGrandi, Weilacher & Young

[57] ABSTRACT

The present invention provides an electrophotographic toner having rheology characteristics, under the conditions of measuring frequency of 1 Hz and measuring distortion of 1 degree, such that:

(1) the drop starting temperature of storage elastic modulus is in the range from 100° to 110° C.;
(2) the storage elastic modulus at 150° C. is not greater than $1\times10^4$ dyn/cm$^2$; and
(3) the peak temperature of loss elastic modulus is not less than 125° C.

The toner is excellent in low-temperature fixing properties, off-set resisting properties and heat resistance.

19 Claims, 2 Drawing Sheets

ELECTROPHOTOGRAPHIC TONER HAVING IMPROVED LOW TEMPERATURE FIXING PROPERTIES, OFF-SET RESISTANCE AND HEAT RESISTANCE

BACKGROUND OF THE INVENTION

The present invention relates to an electrophotographic toner and more particularly to an electrophotographic toner to be used for image forming with the use of an electrostatic copying apparatus, a laser beam printer or the like.

In a magnetic-brush developing method using a two-component developer containing a toner and a carrier, an image is formed according to the following steps in which:

(a) A developer containing an electrophotographic toner is first held around the outer periphery of a developing sleeve incorporating magnetic polarities, thereby to form a so-called magnetic brush;

(b) The magnetic brush is allowed to come in contact with a photoreceptor on the surface of which an electrostatic latent image is being formed, so that the electrophotographic toner is electrostatically stuck to the electrostatic latent image. This causes the electrostatic latent image to be turned into a toner image; and (c) The toner image is transferred to paper from the surface of the photoreceptor and fixed on the paper by heating-fixing. Thus, image forming is completed.

As the electrophotographic toner used for the image forming above-mentioned, there may be used an electrophotographic toner as obtained by blending a fixing resin with a coloring agent such as carbon black, a charge controlling agent and the like and by pulverizing the blended body into particles having sizes in a predetermined range.

The electrophotographic toner above-mentioned is required to have (i) off-set resisting properties for preventing the occurrence of so-called off-set such as contamination of the fixing rollers due to partial sticking of a molten toner to the heating rollers, and (ii) fixing properties for preventing the toner image from being defectively fixed on paper when the fixing temperature is low (deterioration of low-temperature fixing properties).

In an electrophotographic toner using a fixing resin having a high molecular weight to satisfy the off-set resisting properties, it is required to set the fixing temperature to a high temperature. This is not preferable from an energy economy point of view. On the other hand, an electrophotographic toner using a fixing resin having a low molecular weight to satisfy the low-temperature fixing properties is poor in heat resistance because the toner particles are agglomerated and solidified to provoke blocking when the inside of the image forming apparatus is heated to a high temperature.

To give both off-set resisting properties and heat resistance to the toner, there have been proposed various examples of an electrophotographic toner jointly containing resin having low molecular weight and resin having high molecular weight (See, for example, Japanese Patent Unexamined Applications No. 16144/1981 and No. 3644/1985).

In a joint use of low-molecular-weight resin and high-molecular-weight resin, it is difficult to properly determine the blending proportion of both resins. If the amount of the low-molecular-weight component is too little, the resulting toner is poor in low-temperature fixing properties. If the amount of the low-molecular-weight component is too much, the resulting toner is poor in off-set resisting properties. In fact, there has not been obtained a toner which simultaneously satisfies both requirements of fixing properties and off-set resisting properties. Further, when a low-molecular-weight resin and a high-molecular-weight resin are merely jointly used, the resulting toner is insufficient in heat resistance.

To improve a toner in these characteristics, there has been offered a proposal in which attention has been placed on toner rheology characteristics. U.S. Pat. No. 4,913,991 discloses a color toner excellent in luster by determining the range of tangent loss (tan $\delta$) which represents the ratio of storage elastic modulus to loss elastic modulus. Further, EP-A-407083 discloses a toner excellent in fixing properties and off-set resisting properties by determining the range of the tangent loss (tan $\delta$) in a predetermined storage elastic modulus.

However, even the toners having predetermined rheology characteristics set forth in the documents above-mentioned cannot simultaneously satisfy all the requirements of low-temperature fixing properties, off-set resisting properties and heat resistance. More specifically, the toner having rheology characteristics set forth in U.S. Pat. No. 4,913,991 is developed for full-color and therefore made soft such that the toner is readily molten. Accordingly, when the toner is used for mono-color, the toner may readily provoke off-set. The toner having rheology characteristics set forth in EP-A-407083 is not sufficient in heat resistance.

SUMMARY OF THE INVENTION

It is a main object of the present invention to provide an electrophotographic toner excellent in all the requirements of low-temperature fixing properties, off-set resisting properties and heat resistance.

Other objects and advantages of the present invention will become apparent from the detailed description to follow taken in conjunction with the appended claims.

Under the conditions that the measuring frequency is equal to 1 Hz and the measuring distortion is equal to 1 deg, the present invention provides an electrophotographic toner having rheology characteristics such that:

(1) the drop starting temperature of storage elastic modulus is in the range from 100° to 110° C.;

(2) the storage elastic modulus at 150° C. is not greater than $1\times10^4$ dyn/cm$^2$; and (3) the peak temperature of loss elastic modulus is not less than 125° C.

More specifically, the inventors have found that the fixing properties and off-set resisting properties of a toner rather relate to the storage elastic modulus and the loss elastic modulus which represent the dynamic viscoelasticity of the toner, than to the distribution of molecular weights of fixing resins to be used. Based on the findings above-mentioned, the inventors have further prosecuted the study and investigated in detail the relationship between the toner characteristics and (i) a curve representing the relationship between temperature and storage elastic modulus (G') (hereinafter referred to as temperature-G' curve) and (ii) a curve representing the relationship between temperature and loss elastic modulus (G'') (hereinafter referred to as temperature-G'' curve), as shown in FIG. 1. Then, the inventors have found a novel fact that an electrophotographic toner presenting such temperature-G′ curve and temperature-G″ curve as to satisfy the conditions of (1), (2) and (3) above-mentioned, is excellent in low-temperature fixing properties, off-set resisting properties and heat resistance.

DETAILED DESCRIPTION OF THE INVENTION

Figure 1:
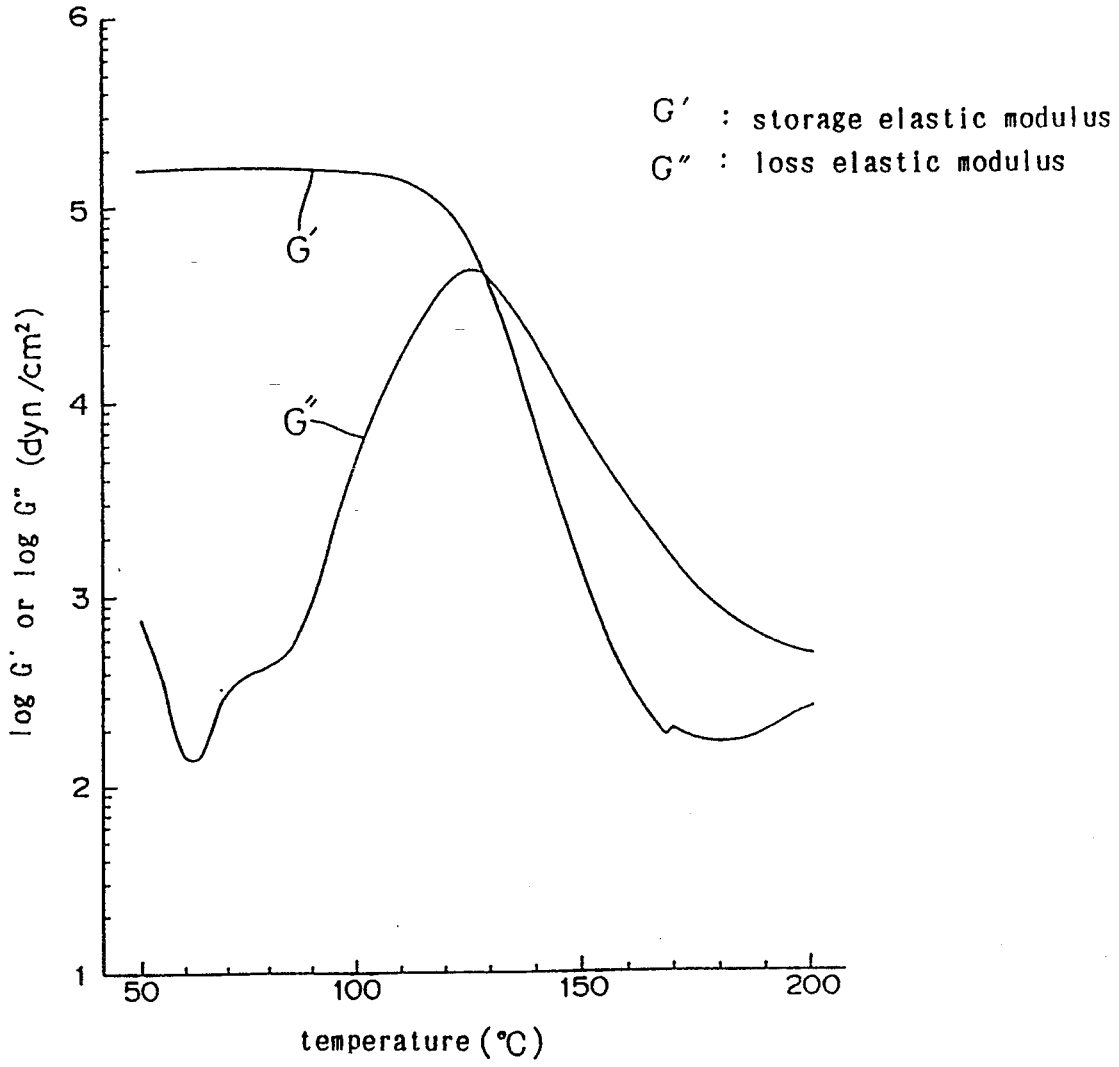
FIG. 1 is a graph showing a temperature-storage elastic modulus curve and a temperature-loss elastic modulus curve of toner in accordance with the present invention.

According to the present invention, the storage elastic modulus and the loss elastic modulus are moduli of viscoelasticity characteristic functions determined in a vibration test conducted on an article having general viscoelasticity. The real number part of a complex elastic modulus refers to the storage elastic modulus, while the imaginary number part thereof refers to the loss elastic modulus. More specifically, the storage elastic modulus presents the degree of toner elasticity, while the loss elastic modulus presents the degree of toner viscosity.

According to the present invention, the drop starting temperature of storage elastic modulus is requried to be in the range from 100° to 110° C. If the drop starting temperature of storage elastic modulus exceeds 110° C., the toner becomes near to an elastic body. This increases the toner in internal cohesive force to lower the toner in paper permeability at the time of fixing. This lowers the fixing ratio. If the drop starting temperature of storage elastic modulus is below 100° C., the toner is poor in heat resistance even though improved in low-temperature fixing properties and fixing ratio.

The storage elastic modulus at 150° C. is required to be not greater than $1\times10^4$ dyn/cm$^2$ and preferably in the range from $1\times10^4$ to $5\times10^2$ dyn/cm$^2$. If the storage elastic modulus at 150° C. exceeds $1\times10^4$ dyn/cm$^2$, the toner is poor in fixing properties.

The peak temperature of loss elastic modulus is required to be not less than 125° C. and preferably in the range from 125° to 140° C. If the peak temperature is below 125° C., the toner is poor in off-set resisting properties and heat resistance.

The electrophotographic toner of the present invention may be prepared by mixing with and dispersing in a fixing resin, additives such as a coloring agent, a charge controlling agent, a releasing agent (off-set preventive agent) and the like, and by pulverizing the mixture into particles having sizes in a predetermined range. To adjust the rheology characteristics of the toner in the predetermined range above-mentioned, the dispersion of the additives such as a coloring agent, a charge controlling agent, a releasing agent and the like in the fixing resin may be changed. More specifically, the period of time of previous-mixing or kneading and the number of rotations of previous-mixing or kneading apparatus may be suitably adjusted at the time of toner production.

The fixing resin to be used is not limited to a specific type. Examples of the fixing resin include epoxy resin, polyester resin, styrene resin, acrylic resin, polyamide resin, petroleum resin, silicone resin, diene resin, olefin resin, a vinyl acetate polymer, polyether, polyurethane, paraffin wax and copolymers of the substances above-mentioned. The examples of the fixing resin may be used alone or in combination of plural types. Of the resins above-mentioned, there may be used preferably the styrene resin and more preferably a styrene-acrylic copolymer.

Figure 2:
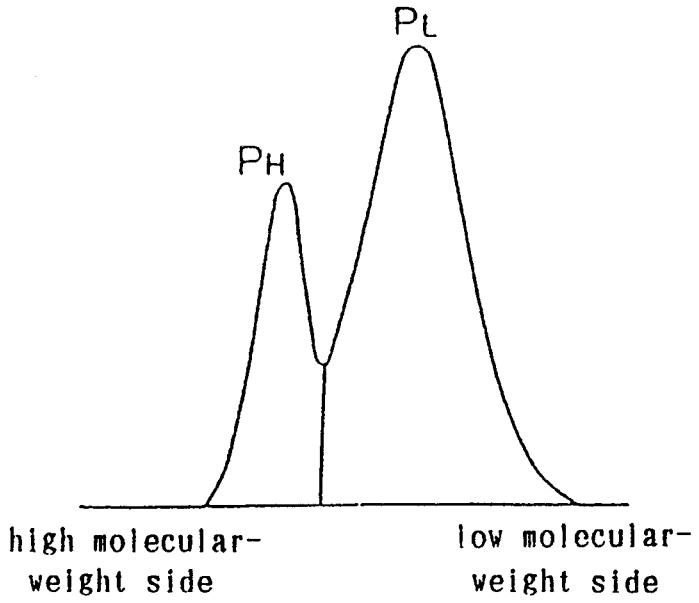
FIG. 2 is a gel permeation chromatogram showing an example of the molecular-weight distribution of a styrene-acrylic copolymer to be used as a fixing resin in the toner in accordance with the present invention.

In the present invention, there may be preferably used a styrene-acrylic copolymer presenting a gel permeation chromatogram of molecular-weight distribution in which maximum values PH and PL are respectively located in the high molecular-weight side and the low molecular-weight side, as shown in FIG. 2. The toner using such a styrene-acrylic copolymer and presenting the rheology characteristics above-mentioned can fully satisfy all the requirements of fixing properties, off-set resisting properties and heat resistance. In the gel permeation chromatogram, another maximum value may be present between the both maximum values PH and PL.

The maximum value PH at the high molecular-weight side is preferably not less than $1\times10^5$ and not greater than $3\times10^5$, and more preferably in the range from $1.5\times10^5$ to $1.9\times10^5$. If the molecular weight of the maximum value PH is less than $1\times10^5$, the high molecular-weight component in the styrene-acrylic copolymer is insufficient in amount. This involves the likelihood that the toner is poor in off-set resisting properties. If the molecular weight of the maximum value PH exceeds $3\times10^5$, this means that the toner contains a great amount of the high-molecular-weight component liable to be cut upon reception of heat and mechanical shearing force. This may rather provoke deterioration in heat resistance.

The molecular weight of the maximum value PL at the low molecular-weight side is preferably not less than $1\times10^3$ and less than $3\times10^5$, and more preferably in the range from $2\times10^3$ to $1\times10^4$. If the molecular weight of the maximum value PL is $1\times10^5$ or more, the low molecular-weight component in the styrene-acrylic copolymer is insufficient in amount, thus failing to produce a toner excellent in fixing properties at a low temperature. On the other hand, if the molecular weight of the maximum value PL is less than $3\times10^3$, the styrene-acrylic copolymer is insufficient in retention, thus failing to produce a toner excellent in durability.

The styrene-acrylic copolymer above-mentioned may be produced either by uniformly melting and blending a plurality of types of styrene-acrylic copolymers having different molecular-weight distributions, or by using a two-stage polymerization.

Figure 3:
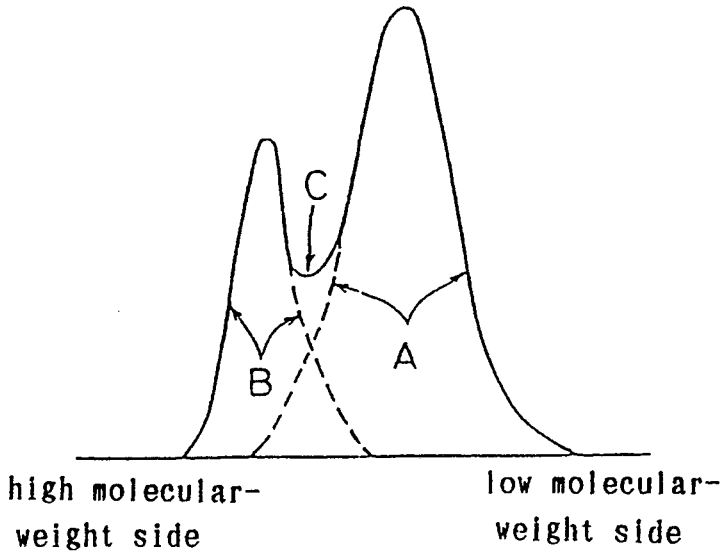
FIG. 3 is a gel permeation chromatogram showing an example of a method of obtaining a styrene-acrylic copolymer presenting the molecular-weight distribution shown in FIG. 2.

For example, as shown in FIG. 3, when there are molten and blended, in the same amount, a styrene-acrylic copolymer (low molecular-weight component) having a molecular-weight distribution shown by a curve A and a styrene-acrylic copolymer (high molecular-weight component) having a molecular-weight distribution shown by a curve B, there is obtained a styrene-acrylic copolymer having a molecular-weight distribution, as shown by a curve C.

According to a suspension polymerization or an emulsion polymerization, a copolymer having a high molecular weight may be generally more easily produced as compared with a solution polymerization. Accordingly, the styrene-acrylic copolymer having the molecular-weight distribution above-mentioned may be produced by a multi-stage polymerization in which the suspension polymerization or the emulsion polymerization and the solution polymerization are combined in this order or in the reverse order with the molecular weight adjusted at each stage. The molecular weight or molecular-weight distribution may be adjusted by suitably selecting the type or amount of an initiator, the type of a solvent, a dispersing agent or an emulsifying agent relating to chain transfer, and the like.

As a styrene monomer which is mainly used in a styrene-acrylic copolymer, there may be used vinyl-toluene, α-methylstyrene or the like, besides styrene. Examples of an acrylic monomer include acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl δ-hydroxyacrylate, ethyl β-hydroxymethacrylate, propyl γ-aminoacrylate, propyl γ-N,N-diethylaminoacrylate, ethylene glycol dimethacrylate, tetraethylene glycol dimethacrylate and the like.

The ratio of the styrene monomer in the styrene-acrylic copolymer is preferably in the range from 40 to 80% by weight for the entire resin in view of the production of a toner which satisfies the fixing properties, off-set resisting properties and heat resistance based on the rheology characteristics mentioned earlier.

Examples of the coloring agent to be used for the electrophotographic toner of the present invention, include a variety of a coloring pigment, an extender pigment, a conductive pigment, a magnetic pigment, a photoconductive pigment and the like. The coloring agent may be used alone or in combination of plural types according to the application.

The following examples of the coloring pigment may be suitably used.

Black

Carbon black such as furnace black, channel black, thermal, gas black, oil black, acetylene black and the like, Lamp black, Aniline black White Zinc white, Titanium oxide, Antimony white, Zinc sulfide Red Red iron oxide, Cadmium red, Red lead, Mercury cadmium sulfide, Permanent red 4R, Lithol red, Pyrazolone red, Watching red calcium salt, Lake red D, Brilliant carmine 6B, Eosine lake, Rhodamine lake B, Alizarine lake, Brilliant carmine 3B Orange Chrome orange, Molybdenum orange, Permanent orange GTR, Pyrazolone orange, Vulcan orange, Indanthrene brilliant orange RK, Benzidine orange G, Indanthrene brilliant orange GK Yellow Chrome yellow, Zinc yellow, Cadmium yellow, Yellow iron oxide, Mineral fast yellow, Nickel titanium yellow, Naples yellow, Naphthol yellow S, Hansa yellow G, Benzidine yellow 10G, Benzidine yellow G, Benzidine yellow GR, Quinoline yellow lake, Permanent yellow NCG, Tartrazine lake Green Chrome green, Chromium oxide, Pigment green B, Malachite green lake, Fanal yellow green G Blue Prussian blue, Cobalt blue, Alkali blue lake, Victoria blue lake, Partially chlorinated phthalocyanine blue, Fast sky blue, Indanthrene blue BC Violet Manganese violet, Fast violet B, Methyl violet lake Examples of the extender pigment include Baryte powder, barium carbonate, clay, silica, white carbon, talc, alumina white and the like.

Examples of the conductive pigment include conductive carbon black, aluminum powder and the like.

Examples of the magnetic pigment include a variety of ferrites such as triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_4$), copper iron oxide ($CuFe_2O_4$), lead iron oxide ($PbFe_{12}O_{19}$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder, cobalt powder, nickel powder and the like.

Examples of the photoconductive pigment include zinc oxide, selenium, cadmium sulfide, cadmium selenide and the like.

The coloring agent may be contained in an amount from 1 to 30 parts by weight and preferably from 2 to 20 parts by weight for 100 parts by weight of the binding resin.

As the electric charge controlling agent, there may be used either one of different electric charge controlling agents of the positive charge controlling type and the negative charge controlling type. As the electric charge controlling agent of the positive charge controlling type, there may be used an organic compound having a basic nitrogen atom such as a basic dye, aminopyrine, a pyrimidine compound, a polynuclear polyamino compound, aminosilane, a filler of which surface is treated with any of the substances above-mentioned. As the electric charge controlling agent of the negative charge controlling type, there may be used a compound containing a carboxy group such as metallic chelate alkyl salicylate or the like.

The electric charge controlling agent may be preferably used in an amount from 0.1 to 10 parts by weight and more preferably from 0.5 to 8 parts by weight for 100 parts by weight of the binding resin.

Examples of the release agent (off-set preventing agent) include aliphatic hydrocarbon, aliphatic metal salts, higher fatty acids, fatty esters, its partially saponified substances, silicone oil, waxes and the like. Of these, there is preferably used aliphatic hydrocarbon of which weight-average molecular weight is from about 1,000 to about 10,000. More specifically, there is suitably used one or a combination of plural types of low-molecular-weight polypropylene, low-molecular-weight polyethylene, paraffin wax, a low-molecular-weight olefin polymer composed of an olefin monomer having 4 or more carbon atoms and the like.

The release agent may be used in an amount from 0.1 to 10 parts by weight and preferably from 0.5 to 8 parts by weight for 100 parts by weight of the binding resin.

The toner is produced by a method of previously mixing the components above-mentioned uniformly with the use of a dry blender, a Henschel mixer, a ball mill or the like, uniformly melting and kneading the resultant mixture with the use of a kneading device such as a Banbury mixer, a roll, a single- or double-shaft extruding kneader or the like, cooling and grinding the resultant kneaded body, and classifying the resultant ground pieces as necessary. The toner may also be produced by suspension polymerization or the like.

The toner particle size is preferably from 3 to 35 μm and more preferably from 5 to 25 μm. A small-particle toner may be used in particle size from about 4 to about 10 μm.

The electrophotographic toner of the present invention thus prepared has specific rheology characteristics and is therefore excellent in low-temperature fixing properties, off-set resisting properties and heat resistance.

EXAMPLES

The following description will discuss the electrophotographic toner of the present invention with reference to examples thereof. It is a matter of course that the present invention should not be limited to the following examples.

EXAMPLE 1

There were mixed (i) 100 parts by weight of a styrene-acrylic copolymer, as a fixing resin, presenting a molecular-weight distribution shown in Table 1, (ii) 10 parts by weight of carbon black ("MA-100" manufactured by Mitsubishi Kasei Co., Ltd.) as a coloring agent, (iii) 2 parts by weight of a charge controlling agent ("S-34" manufactured by Orient Kagaku Co., Ltd.), and (iv) 2 parts by weight of wax ("Viscoal 550P" manufactured by Sanyo Kasei Ko., Ltd.) as an off-set preventing agent. After molten and kneaded, the resulting mixture was cooled, ground and classified to produce a toner having the average particle size of 10 μm. Added to and mixed with the toner thus prepared was 0.2 part by weight of a surface treating agent containing silica powder ("TS-720" manufactured by Cabot Company) and alumina powder ("Aluminium Oxide C" manufactured by Degussa Company) at a ratio by weight of 3:1.

TABLE 1

| | Example 1 | Example 2 | Comparative Example 1 | Comparative Example 2 |
|---|---|---|---|---|
| Peak at high-molecular side | 190000 | 210000 | 129000 | 1080000 |
| Peak at low-molecular side | 5300 | 5000 | 10600 | 19000 |
| Number of peaks | two | two | two | two |

TABLE 1-continued

| | Comparative Example 3 | Comparative Example 4 | Comparative Example 5 | Example 3 |
|---|---|---|---|---|
| Peak at high molecular side | 945000 | 183000 | 700000 | 38000 |
| Peak at low molecular side | 9500 | 5000 | 5800 | |
| Number of Peaks | two | two | two | one |

With "MR-300 Soliquid Meter" manufactured by Rheology Co., Ltd., the temperature-G′ curve and temperature-G″ curve of the toner of Example 1 were measured under the following conditions:

Measuring jig: Cone plate (Cone dia. 3.996 cm, Cone angle 1.969 degree)

Measuring frequency: 1 Hz

Measuring distortion: 1 degree

Measuring temperature: 50° to 200° C.

Based on the temperature-G′ curve and temperature-G″ curve thus obtained, there were obtained the drop starting temperature of storage elastic modulus (G′), and the peak temperatures of storage elastic modulus (G′) and loss elastic modulus (G″) at 150° C. The results are shown in Table 2.

EXAMPLE 2 AND COMPARATIVE EXAMPLES 1 to 5

Respective toners were prepared in the same manner as in Example 1, except for the use of styrene-acrylic copolymers, as a fixing resin, respectively presenting the molecular-weight distributions shown in Table 1. The rheology characteristics of the toners were obtained in the same manner as in Example 1. The results are shown in Table 2.

EXAMPLE 3

A toner was prepared in the same manner as in Example 1, except for the use of a styrene-acrylic copolymer, as a fixing resin, presenting the molecular-weight distribution shown in Table 1. The rheology characteristics of the toner were obtained in the same manner as in Example 1. The results are shown in Table 2.

Each of the toners of the Examples and the Comparative Examples was mixed witch a ferrite carrier (having the average particle size of 80 μm) to prepare a developer (in which the toner concentration was 3.5%). As to each of the developers, the lowest fixing temperature, off-set generating temperature, rubbing fixing ratio and heat resistance were measured in the following manners:

Measurement of Lowest Fixing Temperature

While the setting temperature of the heating roller of an electrophotographic copying apparatus DC-3255 manufactured by Mita Industrial Co., Ltd. (of the heating pressure roller fixing type) was raised in steps of 5° C. from 140° C., paper having thereon a toner image corresponding to a solid-black document was passed in the apparatus, causing the image to be fixed. An adhesive tape was pressingly contacted with each fixed image and then separated. The density data of each fixed image before and after separation were measured with a reflection densitometer. According to the following equation, there was obtained the lowest temperature at which the fixing ratio exceeded 90%. This temperature was referred to as the lowest fixing temperature.

Fixing ratio (%)=(Image density after separation/Image density before separation)×100

Measurement of Off-Set Generating Temperature

By visually checking each paper and the fixing roller for contamination in a continuous reproduction with the electrophotographic copying apparatus above-mentioned, the temperature at which off-set occurred, was regarded as the off-set generating temperature.

Measurement of Rubbing Fixing Ratio

With the temperature of the heating roller of an electrophotographic copying apparatus DC-3255 manufactured by Mita Industrial Co., Ltd. (of the heating pressure roller fixing type) set to 140° C., there was obtained a toner image corresponding to a solid-black document. Placed on each toner image was the following fixing jig with its cotton-cloth surface being opposite to the toner image. The fixing jig was reciprocated by its gravity on the toner image 5 times at a speed of one reciprocation per second. The density data before and after such rubbing were measured with the reflection densitometer. Based on these density data, the fixing ratio was calculated according to the following equation.

Fixing Ratio (%)=(Image density after rubbing/Image density before rubbing)×100

Fixing jig: Soft steel column with a diameter of 50 mm (400 g) with a cotton cloth ("Nikkokarashi" manufactured by Marcel Co., Ltd.) applied to the bottom thereof.

Test of Toner Heat Resistance

A glass cylinder having an inner diameter of 25 mm was charged with 5 g of each toner. With a weight of 100 g placed on the toner, the cylinder was put in an oven and heated for 30 minutes at a predetermined temperature. After the cylinder was cooled at a room temperature for 5 minutes, the cylinder was gently pulled out upwardly. The highest temperature at which the toner presented no collapse, was obtained.

The results of the tests above-mentioned are shown in Table 2.

TABLE 2

| | Example 1 | Example 2 | Comparative Example 1 | Comparative Example 2 |
|---|---|---|---|---|
| Drop starting temperature of G' (°C.) | 103 | 107 | 102 | 92 |
| Value of G' at 150° C. (dyn/cm$^2$) | $1.4 \times 10^3$ | $8.0 \times 10^3$ | $2.6 \times 10^4$ | $2.3 \times 10^3$ |
| Peak temp. of G" (°C.) | 138 | 140 | 139 | 115 |
| Lowest fixing temp. (°C.) | 150 | 150 | 155 | 145 |
| Off-set generating temp. (°C.) | 200 or more | 200 or more | 200 or more | 195 |
| Rubbing fixing ratio (%) | 97 | 95 | 85 | 97 |
| Toner heat resisting temp. (°C.) | 70 | 70 | 70 | 60 |

| | Compa'tive Example 3 | Compa'tive Example 4 | Compa'tive Example 5 | Example 3 |
|---|---|---|---|---|
| Drop starting temperture of G' (°C.) | 93 | 113 | 95 | 103 |
| Value of G' at 150° C. (dyn/cm$^2$) | $5.0 \times 10^3$ | $8.0 \times 10^4$ | $8.0 \times 10^2$ | $6.0 \times 10^2$ |
| Peak temp. G" (°C.) | 110 | 145 | 126 | 128 |
| Lowest fixing temp. (°C.) | 140 | 155 | 140 | 140 |
| Off-set generating temp. (°C.) | 185 | 200 or more | 185 | 190 |
| Rubbing fixing ratio (%) | 98 | 75 | 97 | 97 |
| Toner heat resisting temp. (°C.) | 55 | 75 | 60 | 65 |

The following becomes apparent from the results shown in Table 2. The toners of Examples 1 and 2 are excellent in off-set resisting properties, low-temperature fixing properties and heat resistance. The toner of Comparative Example 1 is higher in the storage elastic modulus at 150° C. than the toners of Examples 1 and 2. Accordingly, the toner of Comparative Example 1 becomes near to an elastic body of which cohesive force is great. Thus, the toner of Comparative Example 1 is poor in rubbing fixing ratio. In Comparative Example 2, the drop starting temperature of storage elastic modulus and the peak temperature of loss elastic modulus are lower than those of Examples 1 and 2. Thus, the toner of Comparative Example 2 is poor in off-set resisting properties and heat resistance. In Comparative Example 3, the drop starting temperature of storage elastic modulus and the peak temperature of loss elastic modulus are lower than those of Examples 1 and 2. Accordingly, the toner of Comparative Example 3 becomes near to a viscous body. Thus, the toner of Comparative Example 3 is poor in off-set resisting properties and heat resistance. In Comparative Example 4, the drop starting temperature of storage elastic modulus and the storage elastic modulus at 150° C. are higher than those of Examples 1 and 2. Thus, the toner of Comparative Example 4 is poor in fixing properties. In Comparative Example 5, the drop starting temperature of storage elastic modulus is lower than those of Examples 1 and 2. Accordingly, even though the storage elastic modulus at 150° C. is low and the peak temperature of loss elastic modulus is high, the toner of Comparative Example 5 is poor in heat resistance and off-set resisting properties. In Example 3, there was used a fixing resin presenting only one peak in the molecular-weight distribution. Accordingly, the toner of Example 3 is inferior in fixing properties, heat resistance and off-set resisting properties to the toners of Examples 1 and 2. However, when the toner of Example 3 was adjusted such that its rheology characteristics were equal to those shown in Table 2, the toner of Example 3 was remarkably improved in characteristics as compared with a toner prepared with the use of the same fixing resin.

It is understood that the foregoing description is given merely by way of illustration and that many variations may be made therein without departing from the spirit of this invention.

What is claimed is:

1. An electrophotographic toner having rheology characteristics, under the conditions of measuring frequency of 1 Hz and measuring distortion of 1 degree, such that:

(1) the drop starting temperature of storage elastic modulus is in the range from 100° to 110° C.;

(2) the storage elastic modulus at 150° C. is not greater than $1 \times 10^4$ dyn/cm$^2$; and (3) the peak temperature of loss elastic modulus is not less than 125° C.

2. An electrophotographic toner according to claim 1, wherein the storage elastic modulus at 150° C. is in the range from $1\times10^4$ to $5\times10^2$ dyn/cm$^2$.

3. An electrophotographic toner according to claim 1, wherein the peak temperature of loss elastic modulus is in the range from 125° to 140° C.

4. An electrophotographic toner according to claim 1, using a fixing resin which presents, in a gel permeation chromatogram of molecular-weight distribution, maximum values at the high-molecular-weight side and the low-molecular-weight side, respectively.

5. An electrophotographic toner, comprising:

a charge controlling agent; an offset preventing agent; a coloring agent; and a fixing resin, wherein the electrophotographic toner has the following rheological characteristics, under the conditions of a measuring frequency of 1 Hz and a measuring distortion of 1 degree:

(a) a drop starting temperature of storage elastic modulus in the range of from 100° to 110° C.;

(b) a storage elastic modulus at 150° C. not greater than $1\times10^4$ dyn/cm$^2$; and (c) a peak temperature of loss elastic modulus not less than 125° C.

6. An electrophotographic toner according to claim 5, wherein the storage elastic modulus at 150° C. is in the range of $1\times10^4$ dyn/cm$^2$ to $5\times10^2$ dyn/cm$^2$.

7. An electrophotographic toner according to claim 5, wherein the peak temperature of loss elastic modulus is in the range from 125° to 140° C.

8. An electrophotographic toner according to claim 5, wherein the fixing resin presents, in a gel permeation chromatogram of molecular weight distribution, maximum values at a high molecular weight side and at a low molecular weight side.

9. An electrophotographic toner according to claim 5, wherein the fixing resin is at least one member selected from the group consisting of:

epoxy resin, polyester resin, styrene resin, acrylic resin, polyamide resin, petroleum resin, silicone resin, diene resin, olefin resin, a vinyl acetate polymer, polyether, polyurethane, paraffin wax and copolymers of these materials.

10. An electrophotographic toner according to claim 9, wherein the fixing resin is a styrene resin or a styrene-acrylic copolymer.

11. An electrophotographic toner according to claim 5, wherein the coloring agent is at least one member selected from the group consisting of:

a coloring pigment, an extender pigment, a conductive pigment, a magnetic pigment and a photoconductive pigment.

12. An electrophotographic toner according to claim 5, wherein the charge controlling agent is a member selected from the group consisting of:

aminopyrine; a pyrimidine compound; a polynuclear polyamino compound; aminosilane; a filler whose surface is treated with aminopyrine, a pyrimidine compound, a polynuclear polyamino compound or aminosilane; and metallic chelate alkyl salicylate.

13. An electrophotographic toner according to claim 5, wherein the offset preventing agent is a member selected from the group consisting of:

aliphatic hydrocarbons, aliphatic metal salts, higher fatty acids, fatty esters, partially saponified fatty ester substances, silicone oil, and waxes.

14. An electrophotographic toner according to claim 5, wherein the offset preventing agent is at least one member selected from the group consisting of:

polypropylene, polyethylene, paraffin wax, and an olefin polymer composed of an olefin monomer having 4 or more carbon atoms.

15. An electrophotographic toner according to claim 5, further comprising a silica containing surface treating agent.

16. An electrophotographic toner according to claim 5, further comprising alumina powder.

17. An electrophotographic toner according to claim 15, further comprising alumina powder.

18. An electrophotographic toner according to claim 4, wherein the fixing resin is a styrene-acrylic copolymer.

19. An electrophotographic toner according to claim 1, wherein the toner includes a fixing resin, and the fixing resin is a member selected from the group consisting of a styrene-acrylic copolymer and a polyester.

* * * * *